US006820522B2

(12) United States Patent
Hu

(10) Patent No.: US 6,820,522 B2
(45) Date of Patent: Nov. 23, 2004

(54) HOOK SCREW DRIVER WITH A TOOL-COUPLING ARRANGEMENT

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 0 days.

(21) Appl. No.: 10/347,825

(22) Filed: Jan. 21, 2003

(65) Prior Publication Data

US 2003/0233913 A1 Dec. 25, 2003

(30) Foreign Application Priority Data

Jun. 20, 2002 (TW) ..... 91113713 A

(51) Int. Cl.[7] ..... B25B 13/56
(52) U.S. Cl. ..... 81/176.3; 81/111; 81/901
(58) Field of Search ..... 81/176.3, 901, 81/177.4, 111, 176.1

(56) References Cited

U.S. PATENT DOCUMENTS 5,566,596 A * 10/1996 Lin ..... 81/490
6,026,715 A * 2/2000 Hu ..... 81/176.3
6,085,617 A * 7/2000 Hu ..... 81/98
6,101,905 A * 8/2000 Hu ..... 81/125
6,186,036 B1 * 2/2001 Huang ..... 81/490
6,237,451 B1 * 5/2001 Wei ..... 81/490
6,378,701 B1 * 4/2002 Kuo ..... 206/378
6,508,156 B1 * 1/2003 Wei ..... 81/490
6,524,035 B1 * 2/2003 Robison ..... 408/211
6,679,142 B1 * 1/2004 Lin ..... 81/437

* cited by examiner

*Primary Examiner*—Lee D. Wilson
(74) *Attorney, Agent, or Firm*—Alan D. Kamrath; Nikolai & Mersereau, P.A.

(57) ABSTRACT

A hook screw driver includes a first body and a second body. An end of the first body is connected to an end of the second body. The other end of the first body and the other end of the second body are movable between an open position and a closed position for clamping a hook screw. The hook screw driver includes a tool-coupling portion for coupling with an end of a tool for tightening/loosening fasteners.

20 Claims, 15 Drawing Sheets

HOOK SCREW DRIVER WITH A TOOL-COUPLING ARRANGEMENT

BACKGROUND OF THE INVENTION

1. Field of the Invention

The present invention relates to a hook screw driver with a tool-coupling arrangement. In particular, the present invention relates to a hook screw driver that has a tool-coupling arrangement for coupling with a tool for driving fasteners in addition to the function of reliably clamping a hook screw.

2. Description of the Related Art

U.S. Pat. No. 6,026,715 discloses a hook screw driver having a holding section and an end section. The holding portion has a first part integral with the end section and a second part. Each part has an inner side that includes a compartment defined in a first end thereof. A soft holding member is received in the compartment and made of a highly deformable, highly frictional material for securely holding a hook portion of a hook screw. A second end of each part has a threading defined in an outer side thereof. A retainer ring with an inner threading is moved forward along a longitudinal direction to threadedly engage with the threading on each part after the hook portion of a hook screw is placed on one of the soft holding members. Thus, the hook portion of the hook screw is held by the hook screw driver. However, it was found that the retainer ring could not move forward to tightly clamp the hook portion of a hook screw having a relatively large thickness. Further, the second part can be opened for receiving/removing the hook screw only when the retainer ring is completely disengaged from the threading on each part, which is inconvenient to the user. Further, the hook screw driver provides a single function of clamping a hook screw. Thus, the user has to carry additional tools such as screwdrivers when tightening/loosening fasteners such as bolts, nuts, and screws.

SUMMARY OF THE INVENTION

An object of the present invention is to provide a hook screw driver that has a tool-coupling arrangement for coupling with a tool for tightening/loosening fasteners such as bolts, nuts, and screws.

A hook screw driver in accordance with the present invention includes a first body and a second body having an end connected to an end of the first body. The other end of the first body and the other end of the second body together clamp a hook screw. A tool-coupling member is provided on the hook screw driver for coupling with an end of a tool for tightening/loosening fasteners. In some cases, the tool-coupling member can be directly used to tighten/loosen a fastener.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
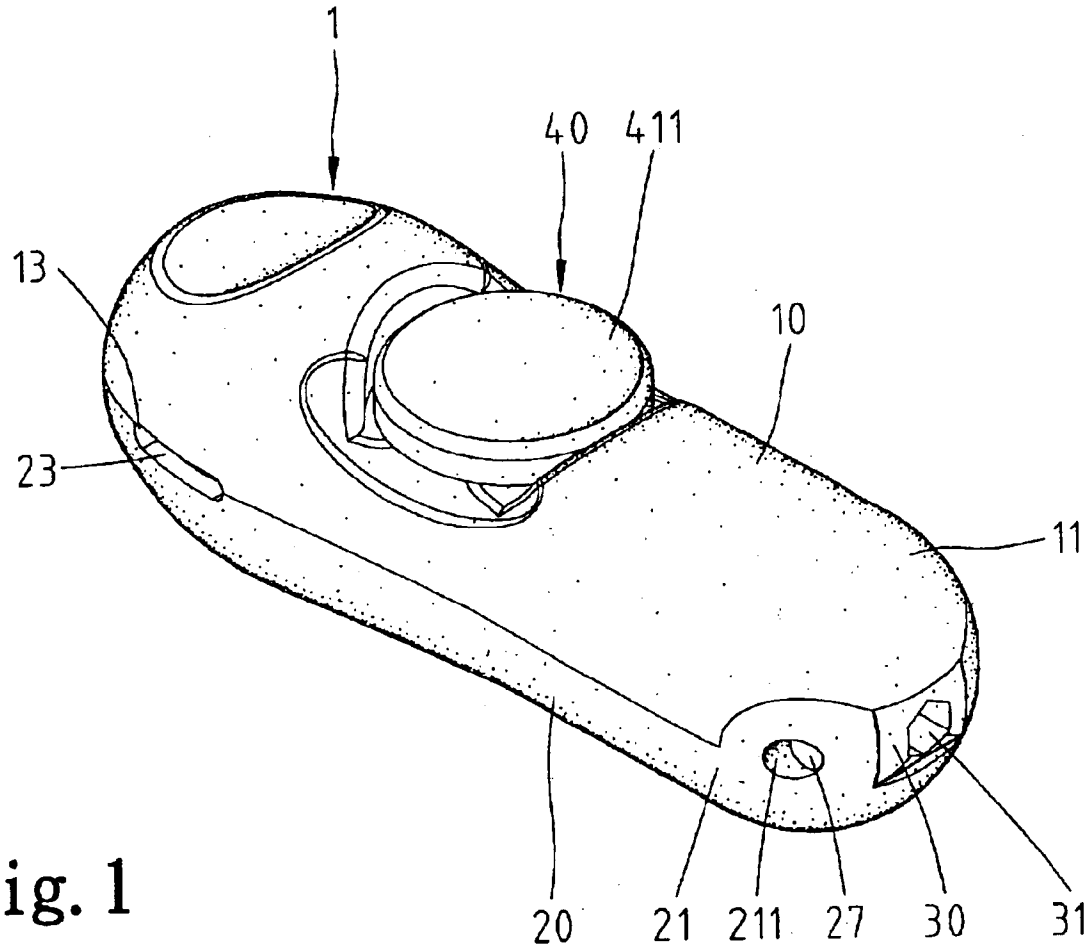
FIG. 1 is a perspective view of a first embodiment of a hook screw driver with a tool-coupling arrangement in accordance with the present invention.
Figure 2:
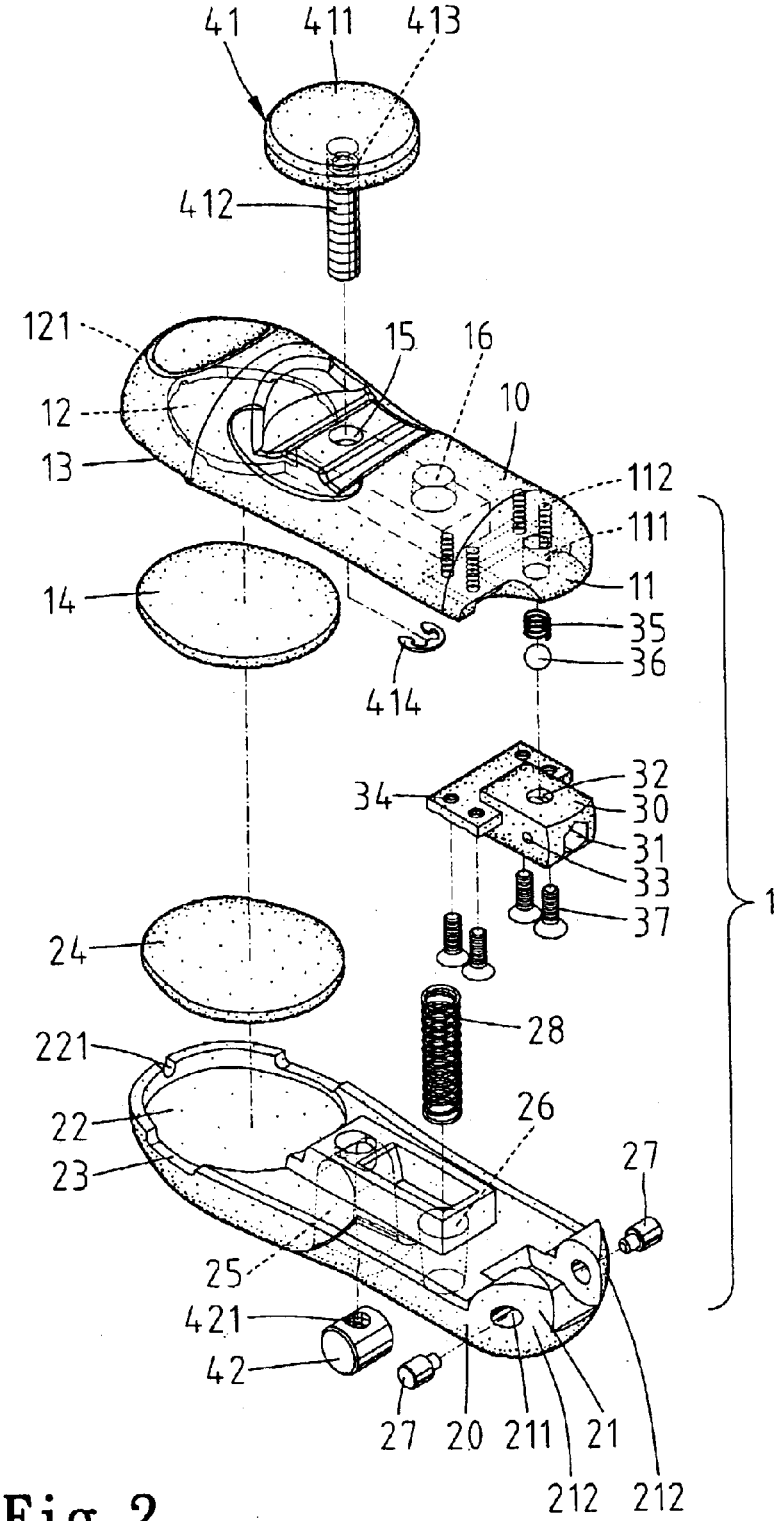
FIG. 2 is an exploded perspective view of the hook screw driver in FIG. 1.
Figure 3:
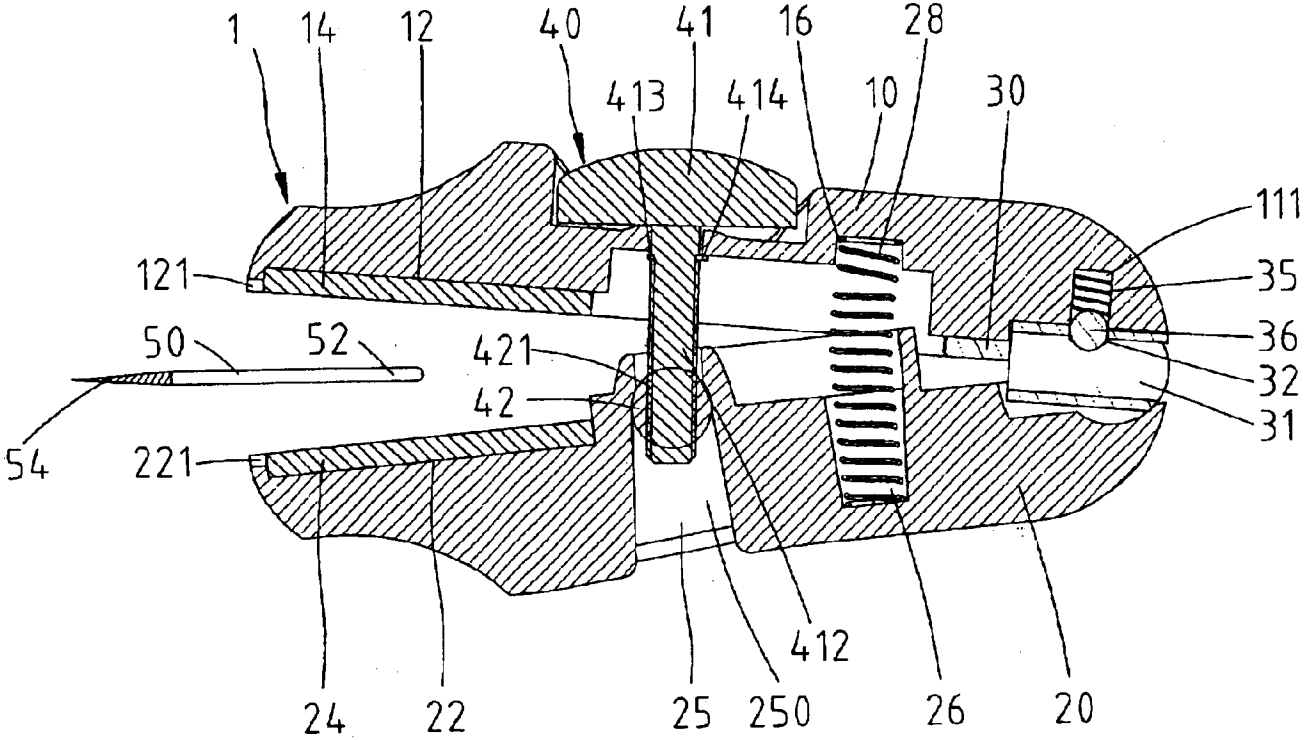
FIG. 3 is a sectional view of the hook screw driver FIG. 1, wherein the hook screw driver is in an open state.

Referring to FIGS. 1 through 3, a first embodiment of a hook screw driver 1 in accordance with the present invention generally comprises a first body 10, a second body 20, and a tightening member 40. The first body 10 has a pivotal section 11 on a first end thereof and a recessed portion 12 on an underside of a second end thereof. The recessed portion 12 of the first body 10 is delimited by a peripheral wall having a positioning hole 121 and a plurality of notches 13. A first holding member 14 is received in the recessed portion 12 of the first body 10 and is preferably made of highly deformable, highly frictional material. A through-hole 15 is defined in an intermediate portion of the first body 10 and extends in a direction substantially perpendicular to an extending direction of the first body 10. Further, a receptacle 16 is defined in an underside of the first body 10.

The second body 20 has a pivotal section 21 on a first end thereof and a recessed portion 22 on a top side of a second end thereof. The pivotal section 21 of the second body 20 is pivotally connected to the pivotal section 11 of the first body 10 by pins 27, which will be described later. The recessed portion 22 of the second body 20 is delimited by a peripheral wall having a positioning hole 221 and a plurality of notches 23. A second holding member 24 is received in the recessed portion 22 of the second body 20 and is preferably made of highly deformable, highly frictional material. A through-hole 25 is defined in an intermediate portion of the second body 20 and extends in a direction substantially perpendicular to an extending direction of the second body 20. Further, a receptacle. 26 is defined in the top side of the second body 20. The pivotal section 21 of the second body 20 further has two spaced lugs 212 having aligned pin holes 211, which will be described later.

The through-hole 25 of the second body 20 is stepped and has a tapered portion 250 tapering upward. An elastic element 28 has a first end received in the receptacle 16 of the first body 10 and a second end received in the receptacle 26 of the second body 20, thereby biasing the second end of the first body 10 away from the second end of the second body 20.

A tightening member 40 is extended through the through-hole 15 of the first body 10 and the through-hole 25 of the second body 20. In this embodiment, the tightening member 40 includes a turning member 41 and a retaining member 42. The turning member 41 in this embodiment has a threaded stem 412 and an end piece 411 securely attached to an upper end of the threaded stem 412. The retaining member 42 is movably mounted in the tapered portion of the through-hole 25 of the second body 20. The retaining member 42 is a substantially cylindrical member extending in a direction perpendicular to the extending direction of the tapered portion 250 of the through-hole 25 of the second body 20 and perpendicular to an extending direction of the threaded stem 412. The retaining member 42 is so sized that the retaining member 42 is movable along the extending direction of the tapered portion of the through-hole 25 until it is stuck in a position shown in FIG. 3 such that it is not rotatable in the tapered portion 250 of the through-hole 25. Further, the retaining member 42 has a screw hole 421 through which the threaded stem 412 extends. Further, a C-clip 414 is mounted in an annular groove 413 of the threaded stem 412 to prevent the threaded stem 412 from disengaging from the first body 10 and the second body 20.

Further, as illustrated in FIGS. 2 and 3, a tool-coupling member 30 is mounted in an end of the hook screw driver 1 opposite to the end for clamping the hook screw 50. In this embodiment, a plurality of screw holes 112 are defined in the underside of the first end of the first body 10. The tool-coupling member 30 has a plurality of fixing holes 34 in an end thereof, and screws 37 are extended through the fixing holes 34 of the tool-coupling member 30 into the screw holes 112 of the first body 10. Further, a receptacle 111 is defined in the underside of the first end of the first body 10 and located in a position closer to an end face of the first end of the first body 10 than the screw holes 112. A coupling hole 31 is defined in the other end of the tool-coupling member 30 and extends in a direction substantially parallel to (including coincident with) a longitudinal axis of the hook screw driver 1. A transverse hole 32 is defined in a lateral side (upper side in FIG. 3) of the tool-coupling member 30 for communicating the receptacle 111 of the first body 10 with the coupling hole 32. An elastic element 35 and an engaging member 36 (a ball in this embodiment) are mounted in the receptacle 111 of the first body 10, with the engaging member 36 being biased by the elastic element 35 to slightly protrude into the tool-coupling hole 31 via the transverse hole 32. The transverse hole 32 is so configured to prevent the engaging member 36 from disengaging from the receptacle 111 of the first body 10. Each pin 27 is extended through the pin hole 211 of an associated one of the spaced lugs 212 of the pivotal section 21 of the second body 20 into a pin hole 33 defined in an associated one of two lateral sides of the tool-coupling member 30, thereby pivotally connecting the first end of the first body 10 to the first end of the second body 20. Of course, the pivotal connection between the first end of the first body 10 and the first end of the second body 20 can be accomplished by any other means.

Figure 4:
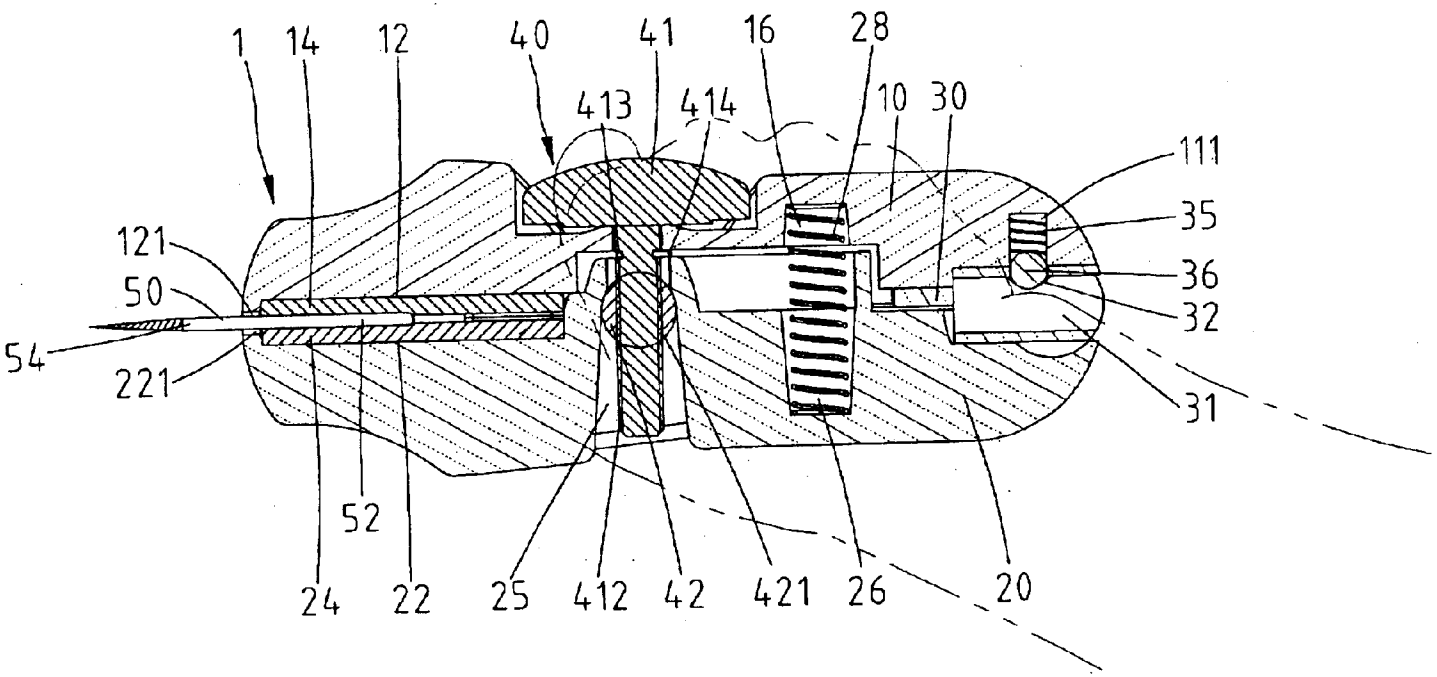
FIG. 4 is a sectional view similar to FIG. 3, wherein the hook screw driver is in a closed state.

When in use, the user turns the end piece 411 of the tightening member 40 and thus causes pivotal movement of the second end of the first body 10 away from the second end of the second body 20 under the action of the elastic element 28 to an open state shown in FIG. 3, as the threaded stem 412 of the tightening member 40 is in threading engagement with the screw hole 421 of the retaining member 42 that is fixed. Then, a hook portion 52 of a hook screw 50 is placed on the second holding member 24, with a straight portion 54 of the hook screw 50 extending beyond the second body 20 via the positioning hole 221 of the second body 20, as best shown in FIG. 4. Next, the user turns the end piece 411 of the tightening member 40 in a reverse direction to cause pivotal movement of the second end of the first body 10 toward the second end of the second body 20 until the second end of the first body 10 presses against the second end of the second body 20, as best shown in FIG. 4. Thus, the hook portion 52 of the hook screw 50 is securely held between the first holding member 14 and the second holding member 24. The first holding member 14 and the second holding member 24 made from highly deformable, highly frictional material assist in positioning of the hook screw 50 while driving the hook screw 50 into, e.g., a timber. It is noted that the straight portion 54 of the hook screw 50 also extends through the positioning hole 121 of the first body 10. It is appreciated that the hook screw tightening arrangement of the hook screw driver 1 can be replaced with any other designs.

Figure 5:
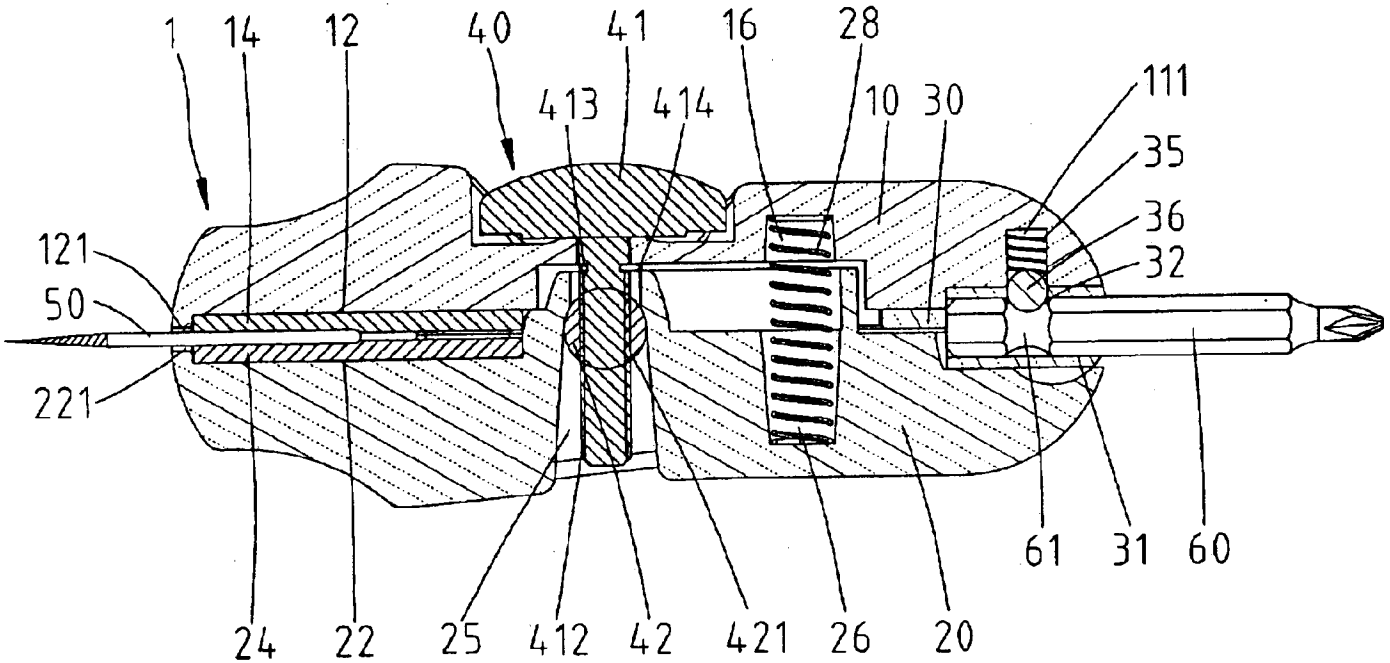
FIG. 5 is a sectional view similar to FIG. 4, wherein a screwdriver blade is coupled to the hook screw driver.

Referring to FIG. 5, a screwdriver blade 60 can be attached to the tool-coupling hole 31 of the tool-coupling member 30. The screwdriver blade 60 has an annular groove 61 in an end thereof. The end of the screwdriver blade 60 is forcibly inserted into the tool-coupling hole 31 of the tool-coupling member 30, which causes the engaging member 36 to move inward and to compress the elastic element 35. When the screwdriver blade 60 is completely inserted into the tool-coupling hole 31 of the tool-coupling member 30, the engaging member 36 is moved outward into the annular groove 61 of the screwdriver blade 60 under the action of the elastic element 35. Thus, when not used for driving a hook screw, the hook screw driver 1 can be used as a screwdriver. Of course, the screwdriver blade 60 can be replaced with any other tool.

Figure 6:
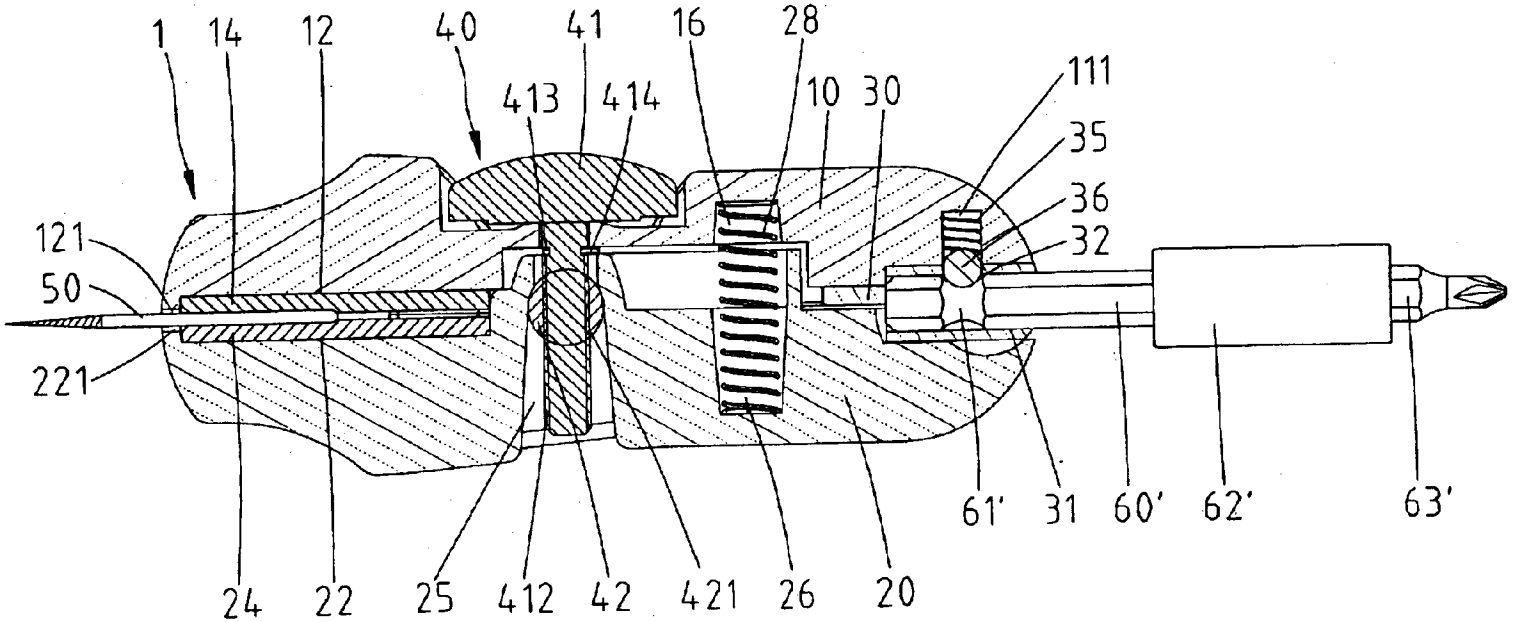
FIG. 6 is a sectional view similar to FIG. 5, wherein a screwdriver bit is coupled to the hook screw driver through a coupling rod having a coupling section.

FIG. 6 illustrates another use of the hook screw driver, wherein a coupling rod 60' having a annular groove 61' is coupled into the tool-coupling hole 31 of the tool-coupling member 30. The coupling rod 60' has a coupling section 62' on an outer end thereof. And a screwdriver bit 63' is coupled to the coupling section 62'. Thus, the hook screw driver I can be used as a screwdriver when not used for driving a hook screw. Of course, the screwdriver bit 63' can be replaced with any other desired tool.

Figure 7:
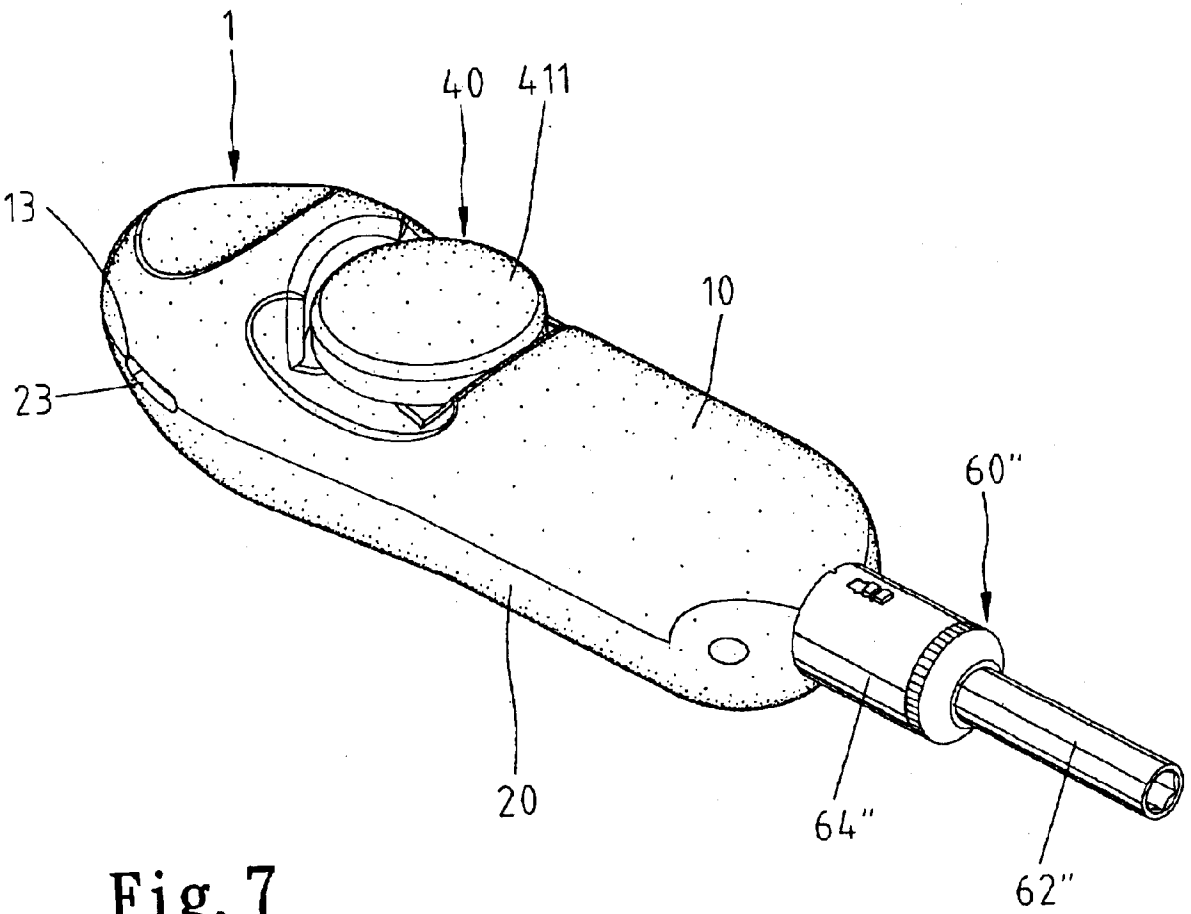
FIG. 7 is a perspective view illustrating attachment of a tool with a ratchet shifter to the hook screw driver in accordance with the present invention.

FIG. 7 is a perspective view illustrating attachment of a tool 60" to the hook screw driver in accordance with the present invention. The tool 60" has a tool driving section 62" and a ratchet shifter 64" allowing a change in the ratcheting direction, which is conventional and therefore not described in detail.

Figure 8:
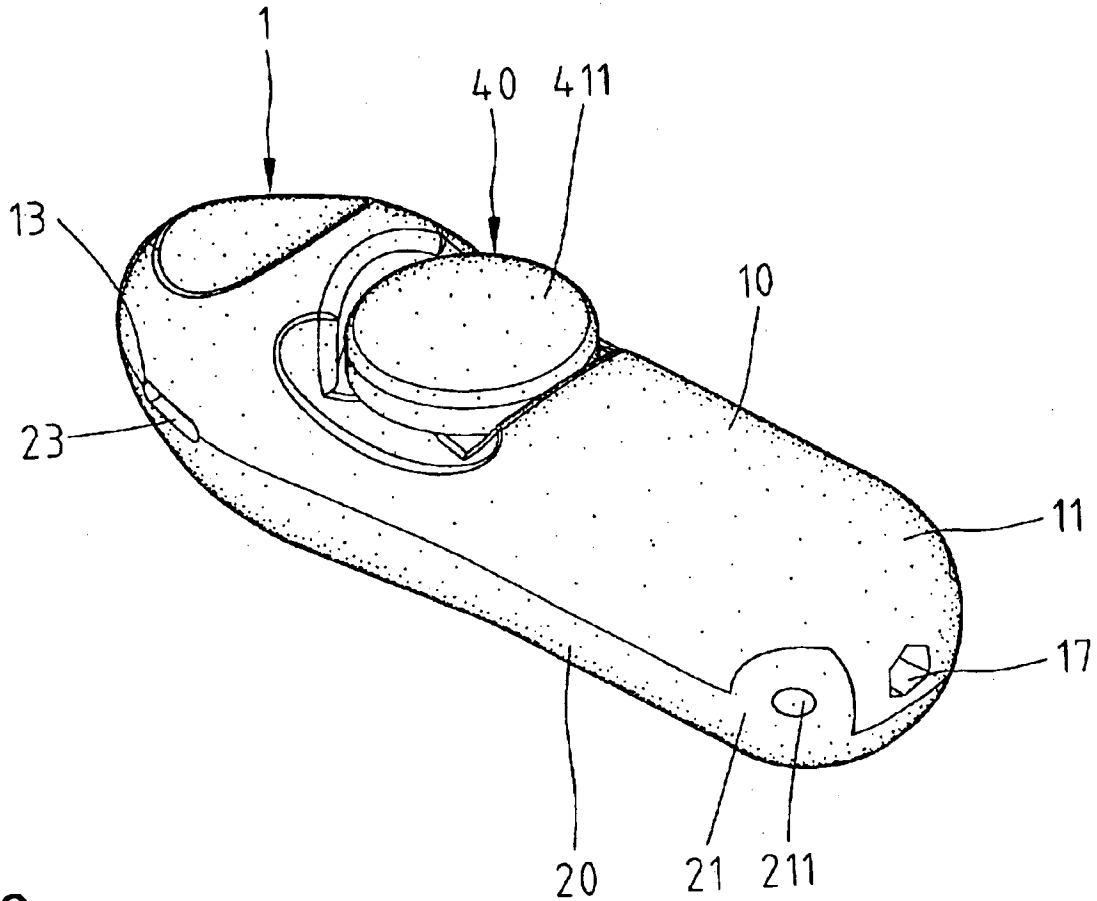
FIG. 8 is a perspective view illustrating a modified embodiment of the hook screw driver in accordance with the present invention.
Figure 9:
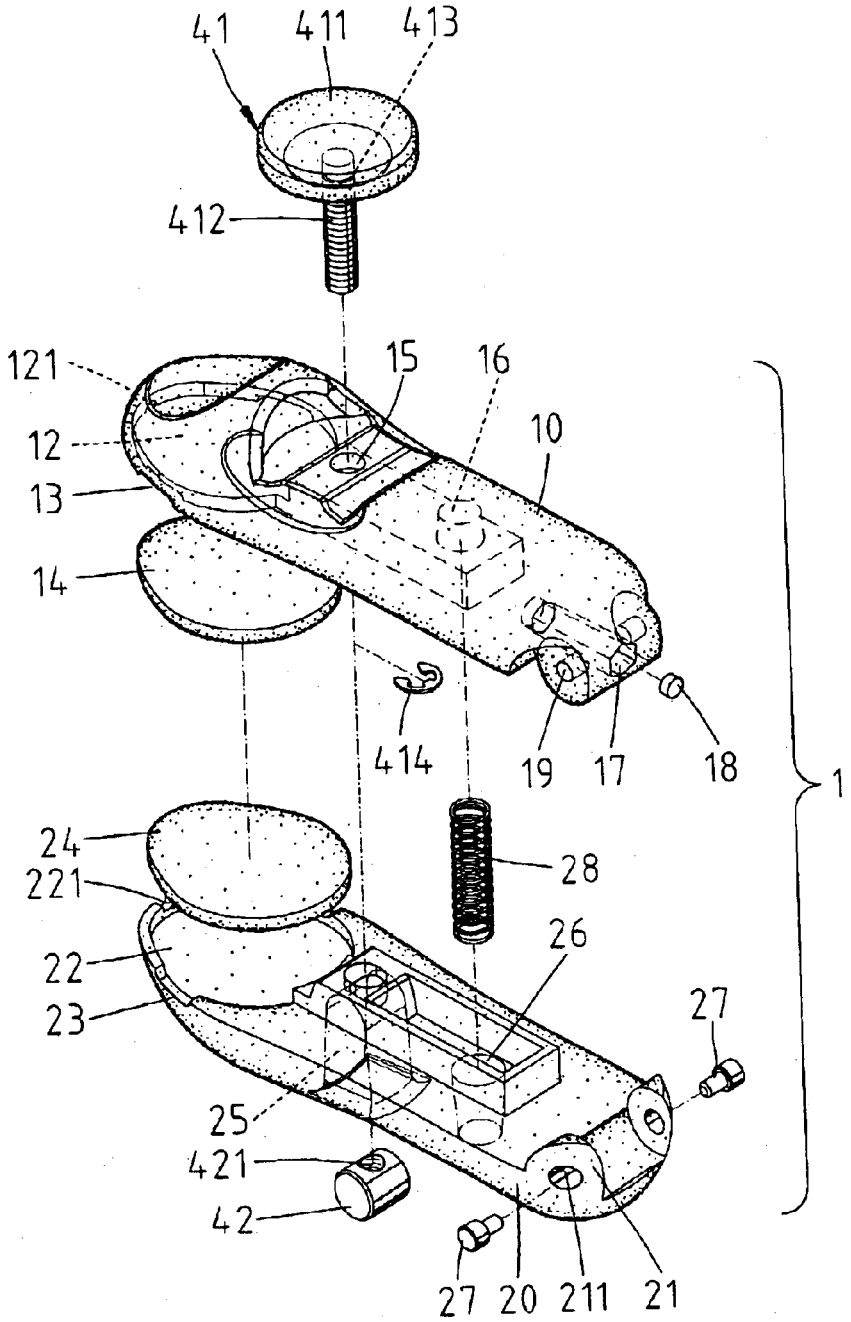
FIG. 9 is an exploded perspective view of the hook screw driver in FIG. 8.
Figure 10:
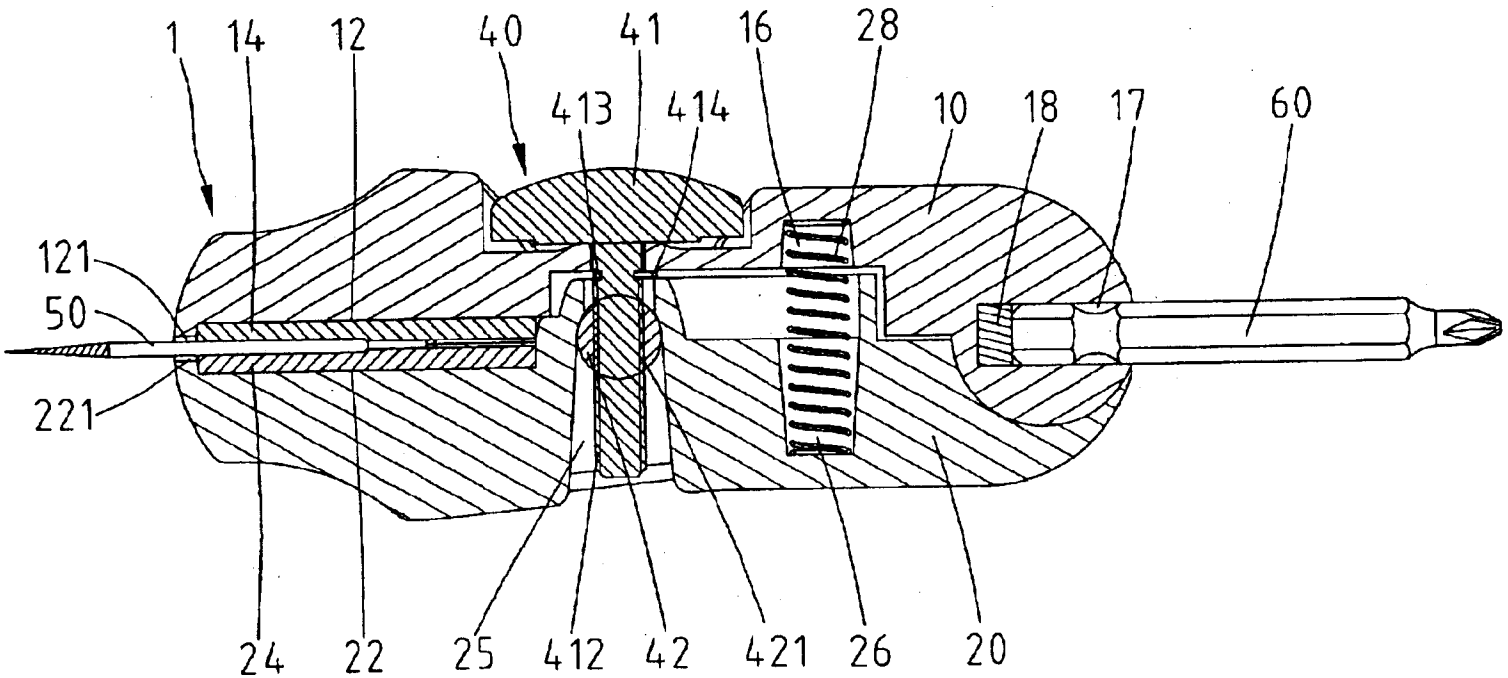
FIG. 10 is a sectional view of the hook screw driver in FIG. 9, wherein a bit is attached to the hook screw driver.

FIGS. 8 through 10 illustrate a modified embodiment of the hook screw driver in accordance with the present invention, wherein the end of the hook screw driver 1 opposed to the other end of the hook screw driver 1 for clamping a hook screw includes a tool-coupling hole 17. In this embodiment, a hexagonal tool-coupling hole 17 is defined in the first body 10, with a magnetic member 18 being fixed to an end wall delimiting the tool-coupling hole 17. Thus, the tool-coupling hole 17 provides a female coupling member for coupling an end of a screwdriver blade 60, as shown in FIG. 10.

Figure 11:
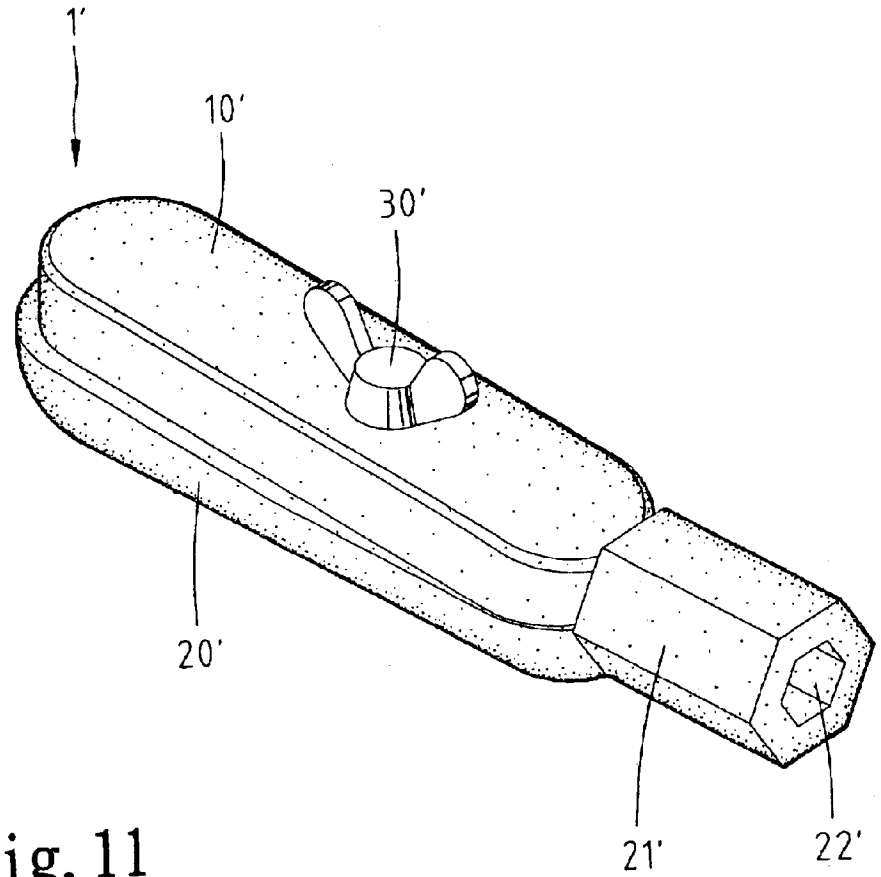
FIG. 11 is a perspective view illustrating another modified embodiment of the hook screw driver in accordance with the present invention.
Figure 12:
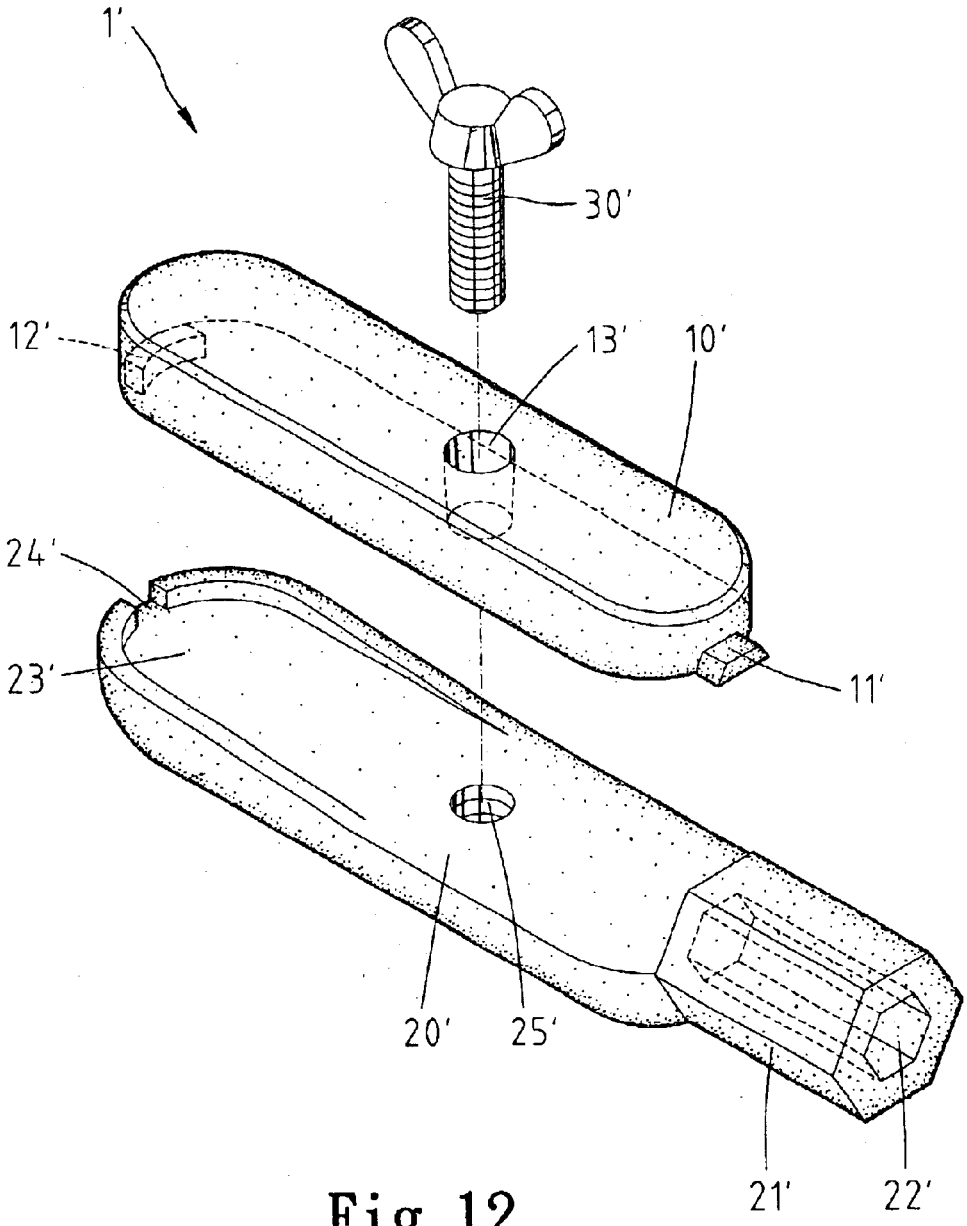
FIG. 12 is an exploded perspective view of the hook screw driver in FIG. 11.
Figure 13:
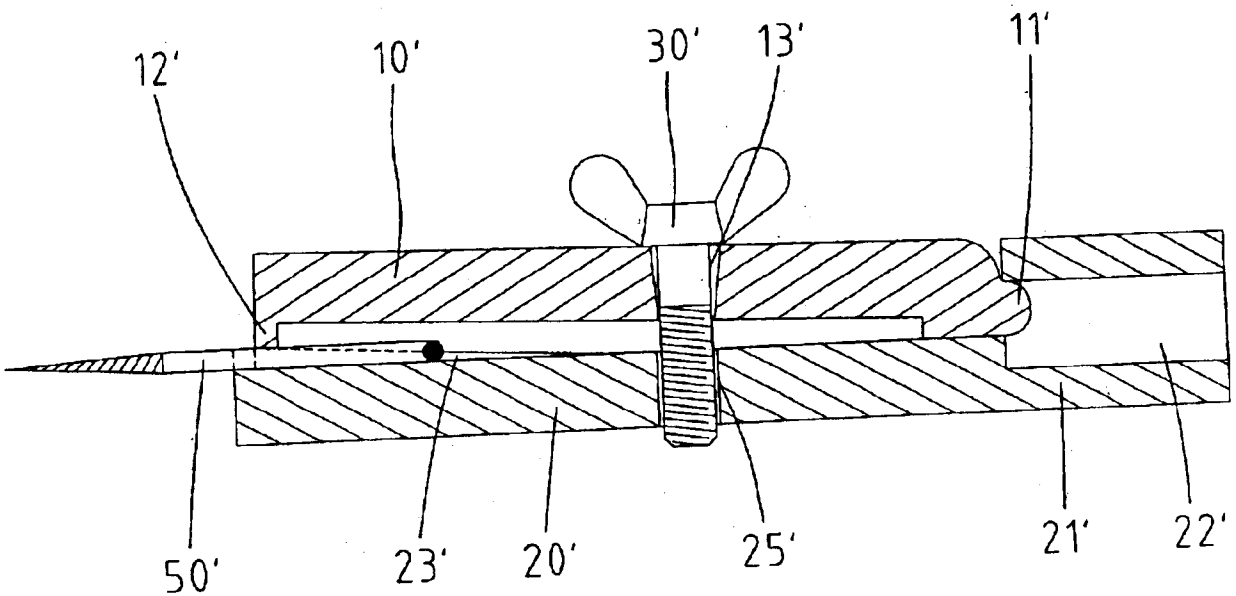
FIG. 13 is a sectional view of the hook screw driver in FIG. 11.

FIGS. 11 through 13 illustrate another modified embodiment of the hook screw driver in accordance with the present invention. In this embodiment, the hook screw driver 1' includes a first body 10', a second body 20', and a tightening member 30'. The first body 10' has a first end connected to a first end of the second body 20'. A tool-coupling portion 21' is formed on the first end of the second body 20' and has a hexagonal tool-coupling hole 22' extending therethrough. Preferably, the hexagonal tool-coupling hole 22' is parallel to (including coincident with) the longitudinal axis of the hook screw driver 1'. The first end of the first body 10' has a protruded portion 11' that is pivotably received in an end of the tool-coupling hole 22'. The other end of the tool-coupling hole 22' can be used to couple with an end of a tool for tightening/loosening fasteners. Of course, the other end of the hexagonal tool-coupling hole 22' can be used to directly drive a fastener such as a bolt head or nut. In either case, the hook screw driver 1' can drive fasteners when not used for driving a hook screw.

The first body 10' includes a pressing member 12' formed on a second end thereof and facing the second body 20'. The second body 20' has a recessed portion 23' facing the first body 10', and a peripheral wall of the recessed portion 23' has a positioning hole 24'. A through-hole 13' is defined in an intermediate portion of the first body 10' and extends in a direction substantially perpendicular to an extending direction of the first body 10'. A threaded through-hole 25' is defined in an intermediate portion of the second body 20' and extends in a direction substantially perpendicular to an extending direction of the second body 20'.

The tightening member 30' is in the form of a butterfly bolt and has a threaded stem (not labeled) extending through the through-hole 13' of the first body 10' and the threaded through-hole 25' of the second body 20'. The tightening member 30' can be turned in a direction and thus move upward to a position allowing the second end of the first body 10' to pivot away from the second end of the second body 20'. Thus, a hook portion (not labeled) of a hook screw 50' can be placed into the recessed portion 23' of the second end of the second body 20', with a straight portion (not labeled) of the hook screw 50' extending beyond the second body 20' via the positioning hole 24'. The tightening member 30' is then turned in a reverse direction to make the second end of the first body 10' pivot toward the second end of the second body 20' until the pressing member 12' of the first body 10' presses against the hook screw 50', as best shown in FIG. 13. Thus, the hook screw 50' is securely held between the second end of the first body 10' and the second end of the second body 20'.

Figure 14:
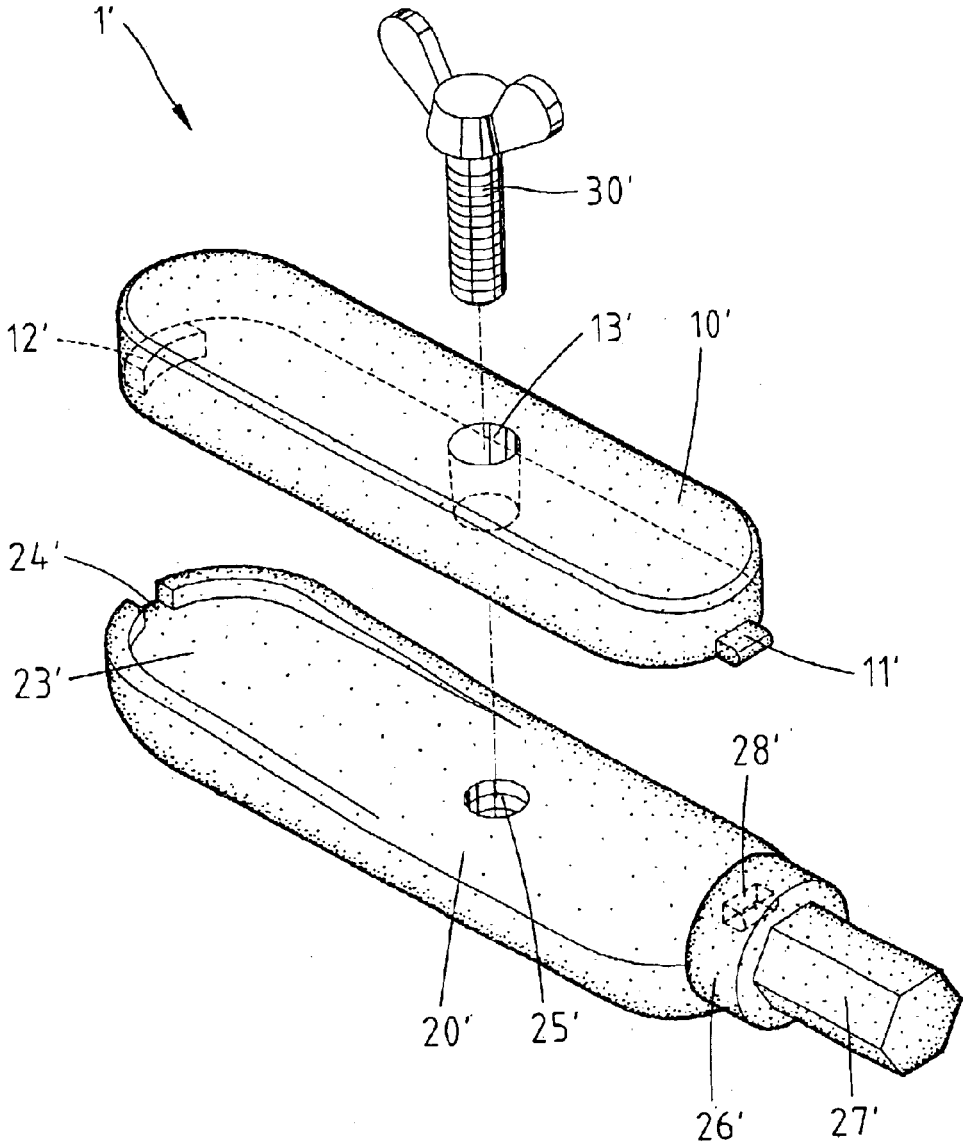
FIG. 14 is an exploded perspective view illustrating a further modified embodiment of the hook screw driver in accordance with the present invention.
Figure 15:
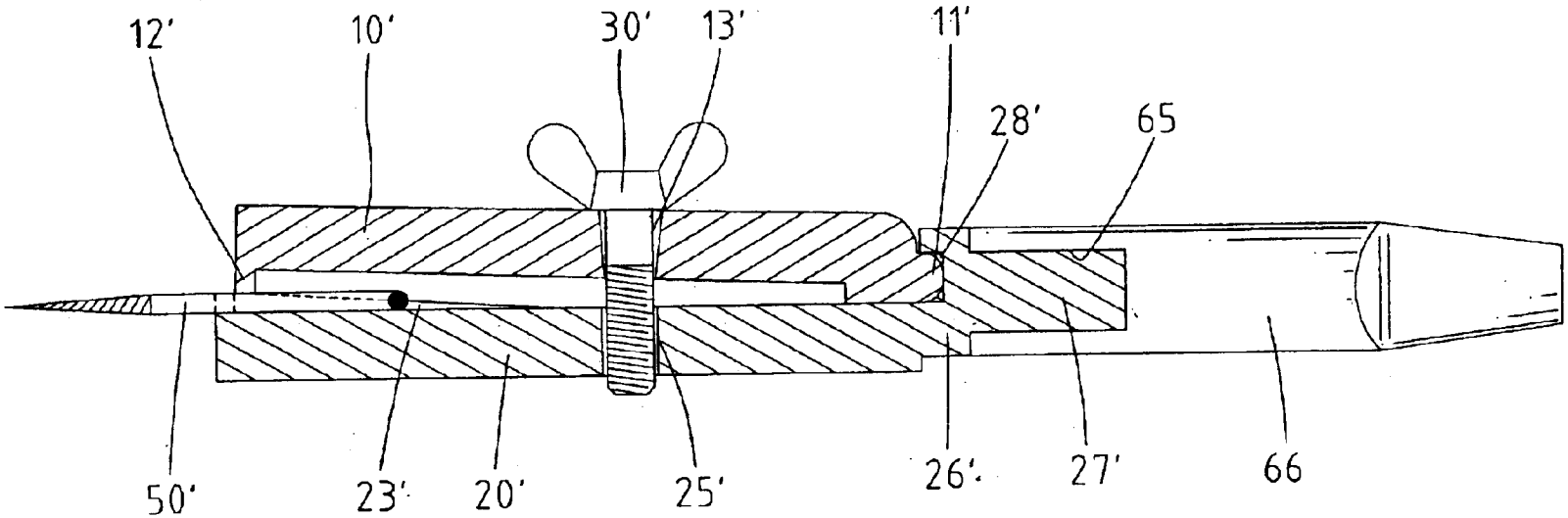
FIG. 15 is a sectional view of the hook screw driver in FIG. 14, wherein a screwdriver blade is attached to the hook screw driver.

FIGS. 14 and 15 illustrate a further modified embodiment that is modified from the embodiment of FIGS. 11 through 13. In this embodiment, the first end of the second body 20' has a coupling portion 26' having a groove 28' in a side thereof for receiving a protruded portion 11' on the first end of the first body 10'. The protruded portion 11' of the first body 10' can pivot in the groove 28' of the second body 20'. Further, a male tool-coupling member 27', e.g., in the form of a hexagonal column, is formed on the other side of the coupling portion 26' for coupling with a groove 65 in an end of a tool, e.g., a screwdriver blade 66. Of course, the tool-coupling member 27' can be directly engaged with a hexagonal groove in a fastener. In either case, the hook screw driver 1' can be used to tighten/loosen a fastener.

Although the invention has been explained in relation to its preferred embodiments, it is to be understood that many other possible modifications and variations can be made without departing from the scope of the invention as hereinafter claimed.

What is claimed is:

1. A hook screw driver comprising a first body having a first end and a second ends; a second body having a first end and a second end, the first end of the first body being connected to the first end of the second body, the second end of the first body and the second end of the second body being movable between an open position and a closed position for clamping a hook screw between the second ends of the first and second bodies in the closed position; and a tool-coupling portion at the first ends of the first and second bodies, with the tool-coupling portion for coupling with an end of a tool for tightening/loosening fasteners.

2. The hook screw driver as claimed in claim 1, wherein the tool-coupling portion is a tool-coupling hole defined in the first end of the first body.

3. The hook screw driver as claimed in claim 2, wherein the tool-coupling hole is hexagonal.

4. The hook screw driver as claimed in claim 2, wherein the tool-coupling hole extends in a direction parallel to a longitudinal axis of the hook screw driver.

5. The hook screw driver as claimed in claim 2, wherein a magnetic member is fixed to an end wall delimiting the tool-coupling hole.

6. The hook screw driver as claimed in claim 1, wherein the tool-coupling portion is formed outside the first and second bodies and includes a tool-coupling hole.

7. The hook screw driver as claimed in claim 6, wherein the tool-coupling hole is hexagonal.

8. The hook screw driver as claimed in claim 7, wherein the tool-coupling hole extends in a direction parallel to a longitudinal axis of the hook screw driver.

9. The hook screw driver as claimed in claim 1, wherein the first end of the first body is pivotally connected to the first end of the second body.

10. The hook screw driver as claimed in claim 9, wherein a tool-coupling member is mounted between the first end of the first body and the first end of the second body, the tool-coupling member including a tool-coupling hole extending in a direction parallel to a longitudinal axis of the hook screw driver.

11. The hook screw driver as claimed in claim 10, wherein the tool-coupling hole is hexagonal.

12. A hook screw driver comprising a first body having a first end and a second end; a second body having a first end and a second end, the first end of the first body being connected to the first end of the second body, the second end of the first body and the second end of the second body being movable between an open position and a closed position for clamping a hook screw; and a tool-coupling portion for coupling with an end of a tool for tightening/loosening fasteners, wherein the tool-coupling portion is formed outside the hook screw driver and includes a male tool-coupling member.

13. The hook screw driver as claimed in claim 12, wherein the male tool-coupling member is hexagonal.

14. The hook screw driver as claimed in claim 12, wherein the male tool-coupling member extends in a direction parallel to a longitudinal axis of the hook screw driver.

15. A hook screw driver comprising a first body having a first end and a second; a second body having a first end and a second end, the first end of the first body being connected to the first end of the second body, the second end of the first body and the second end of the second body being movable between an open position and a closed position for clamping a hook screw; a tool-coupling portion for coupling with an end of a tool for tightening/loosening fasteners; and a tool-coupling member mounted between the first end of the first body and the first end of the second body, the tool-coupling member including a tool-coupling hole extending in a direction parallel to a longitudinal axis of the hook screw driver, wherein the first end of the first body includes a receptacle, an elastic element and an engaging member being mounted in the receptacle, the tool-coupling member including a hole that communicates the receptacle with the tool-coupling hole, the engaging member being biased by the elastic element to partially protrude into the tool-coupling hole of the tool-coupling member for releasably engaging with an engaging groove of a tool.

16. The hook screw driver as claimed in claim 15, wherein the tool-coupling member is fixed to the first end of the first body and has two lateral sides each having a pin hole, the first end of the second body including two spaced lugs having aligned pin holes, two pins being respectively extended through the pin holes of the second body into the pin holes of the tool-coupling member, thereby pivotally connecting the first end of the first body to the first end of the second body.

17. The hook screw driver as claimed in claim 15, wherein a coupling rod has a first end coupled with the tool-coupling hole and a second end, a coupler having an end coupled to the second end of the coupling rod, and a tool being coupled to another end of the coupler.

18. The hook screw driver as claimed in claim 15, wherein the first end of the first body is pivotally connected to the first end of the second body.

19. A hook screw driver comprising: a hook screw including a hook portion and a straight portion extending generally perpendicular to the hook portion; a tool for tightening/loosening fasteners, with the tool having an end; a first body having a first end and a second end; a second body having a first end and a second end, with the first end of the first body being connected to the first end of the second body; means for selectively clamping the hook screw between the first and second bodies, with the second end of the first body and the second end of the second body being movable between an open position and a closed position, with the hook screw being removable/insertable from between the second ends of the first and second bodes in the open position and being clamped between the second ends of the first and second bodies in the closed position; and means for coupling with the end of the tool, with the coupling means located at the first ends of the first and second bodies.

20. The hook screw driver of claim 19 wherein the straight portion extends parallel to a longitudinal axis between the first and second ends of the first and second bodies, with the coupling means extending parallel to the longitudinal axis, with the coupling means coupling the tool by moving the tool parallel to the longitudinal axis.

* * * * *